US011274462B2

(12) United States Patent
Tryber et al.

(10) Patent No.: US 11,274,462 B2
(45) Date of Patent: Mar. 15, 2022

(54) CONTROLLING A MOVEMENT OF A POOL CLEANING ROBOT

(71) Applicant: Maytronics Ltd., Kibutz Yizrael (IL)

(72) Inventors: Eyal Tryber, Shimsheet (IL); Shay Witelson, Kibbutz Yizrael (IL)

(73) Assignee: MAYTRONICS LTD., Kibutz Yizrael (IL)

( * ) Notice: Subject to any disclaimer, the term of this patent is extended or adjusted under 35 U.S.C. 154(b) by 129 days.

(21) Appl. No.: 16/877,416

(22) Filed: May 18, 2020

(65) Prior Publication Data

US 2020/0277804 A1 Sep. 3, 2020

Related U.S. Application Data

(63) Continuation of application No. 14/844,010, filed on Sep. 3, 2015, now Pat. No. 10,704,283.

(60) Provisional application No. 62/045,026, filed on Sep. 3, 2014.

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654
See application file for complete search history.

(56) References Cited

U.S. PATENT DOCUMENTS

| | | | | |
|---|---|---|---|---|
| 4,835,809 A * | 6/1989 | Roumagnac | ..... | E04H 4/1672 15/1.7 |
| 4,837,886 A | 6/1989 | Rawlins | | |
| 4,939,980 A | 7/1990 | Supra | | |
| 5,771,987 A * | 6/1998 | Marbach | ..... | E04H 4/1654 180/6.66 |
| 5,985,156 A | 11/1999 | Henkin | | |
| 2013/0146106 A1 | 6/2013 | Ehrlich | | |

* cited by examiner

*Primary Examiner* — Randall E Chin
(74) *Attorney, Agent, or Firm* — Reches Patents

(57) ABSTRACT

A pool cleaning robot that includes a ballast tank for controlling a buoyancy of the submarine pool cleaner; at least one cleaning element for cleaning debris from an underwater surface of a pool while the pool cleaning robot hovers over the underwater surface; a propulsion module that is configured to propel the submersible pool cleaner; and a steering module that comprises a rudder and diving planes.

21 Claims, 16 Drawing Sheets

CONTROLLING A MOVEMENT OF A POOL CLEANING ROBOT

CROSS-REFERENCE

This application claims priority from U.S. patent application Ser. No. 14/844,010 filing date Sep. 3, 2015, now U.S. Pat. No. 10,704,283, which claims priority from U.S. provisional patent 62/045,026 filing date Sep. 3, 2014—both being incorporated herein by reference.

BACKGROUND OF THE INVENTION

Pool cleaning robots are adapted for use for cleaning a pool while being connected to electrical power cables or to a hose of a suction system. The hose and/or power cable can get tangled and may temporarily limit the usage of the pool so therefore cable swiveling systems or battery operated cleaners are also used.

Pool cleaning robots are adapted for scanning or cleaning swimming pool surfaces such as floor and walls. Debris and dirt such as leaves float on the water surface and only after being soaked with water does the debris or dirt sink to the bottom surface and is then being able to be vacuumed by the pool cleaning robot. It is advantageous to have a pool cleaning robot that can perform both operations i.e.: skimming the surface and then sinking to the bottom to clean floor and wall surfaces.

Pool cleaning robots have difficulty in reaching certain areas of the pool such as stairs, corners or sidewall ledges that are difficult for the pool cleaning robot to reach or access and clean. This is because the basic vehicle configuration of pool cleaning robot s that may include wheels and/or tracks to traverse the floor and wall surfaces making it difficult or impossible to travel and effectively engage obstacles or reach all areas of the pool.

Once a filter of a pool-cleaning robot becomes clogged, the pool cleaning robot is manually taken out of the pool and its filter can be washed by a user of the pool cleaning robot.

Taking a pool-cleaning robot out of the pool is a time and effort consuming operation that is not very fond by the users. In many cases the users delay these manual operations or even skip them causing the pool cleaning robot to operate in a sub-optimal manner.

There is a growing need to provide autonomous robots that can effectively reach, brush and clean difficult to reach areas in the pool.

There is a growing need to provide autonomous robots that require a lesser amount of human intervention in their operation and in their maintenance.

SUMMARY OF THE INVENTION

According to an embodiment of the invention there may be provided a pool cleaning robot that may include a ballast tank for controlling a buoyancy of the submarine pool cleaner; at least one cleaning element for cleaning debris from an underwater surface of a pool while the pool cleaning robot hovers over the underwater surface; a propulsion module that is configured to propel the submersible pool cleaner; and a steering module that comprises a rudder and diving planes.

According to an embodiment of the invention there may be provided a pool cleaning robot and a movable base that are detachably coupled to each other; wherein the pool cleaning robot, may include a ballast tank for controlling a buoyancy of the submarine pool cleaner; at least one cleaning element for cleaning debris from an underwater surface of a pool while the pool cleaning robot hovers over the underwater surface; a propulsion module that may be configured to propel the submersible pool cleaner; and a steering module that may include a rudder and diving planes; wherein the movable base may be configured to support the pool cleaning robot while the movable base propagates underwater and to supply power to the pool cleaning robot. The movable base may also support the pool cleaning robot while being static. It is expected that when the pool cleaning robot hovers about a fixed location the movable base is static.

The underwater surface may be positioned above a bottom of the pool and wherein the pool cleaning robot may include a navigation module for navigating the pool cleaning robot to a hovering position above the underwater surface.

The pool cleaning robot may be configured to reach the hovering position without climbing on any pool structural element that leads to the underwater surface.

The pool cleaning robot may include a fluid conduit for selectively filling the ballast tank with fluid; wherein the fluid conduit has an opening that may be positioned at a lower part of the submersible pool cleaner.

The pool cleaning robot may include a fluid conduit for selectively filling the ballast tank with fluid; wherein the fluid conduit has an opening that may be positioned at an upper part of the submersible pool cleaner.

The pool cleaning robot may include a skimmer that may be positioned at a lower part of the submersible pool cleaner and a fluid conduit for selectively filling the ballast tank with fluid; wherein the fluid conduit fluidly couples the skimmer to the ballast tank.

The ballast tank may be configured to suck fluid through the fluid conduit when the pool cleaning robot is in an inverted position.

The pool cleaning robot when the pool cleaning robot may be configured to be in the inverted position when collecting floating dirt that floats on a fluid of the pool.

The pool cleaning robot may include a skimmer that may be positioned at an upper part of the submersible pool cleaner; and a fluid conduit for selectively filling the ballast tank with fluid; wherein the fluid conduit fluidly couples the skimmer to the ballast tank.

The ballast tank may be configured to suck fluid through the fluid conduit when the pool cleaning robot is in a non-inverted position.

The pool cleaning robot when the pool cleaning robot may be configured to be in the non-inverted position when collecting floating dirt that floats on a fluid of the pool.

The at least one cleaning element may include one or more bottom brushes that are coupled to a bottom of a housing of the cleaning robot and one or mode side suction brushes that are coupled to sides of the housing.

The at least one cleaning element may include one or more bottom brushes that are coupled to a bottom of a housing and one or more balancing wheels that are spaced apart from the one or more bottom suction brushes.

The at least one cleaning element may include an arm that extends from a housing of the submersible pool cleaner; wherein the at least one cleaning element may include an external suction brush that may be coupled to the arm.

The arm may be configured to place the external brush at an upper position that may be above the housing.

The when positioned at the upper position the external brush may be directed downwards.

The ballast tank may include piston that may be contained in a closed space; wherein the piston partitions the closed space to a first and second compartment; wherein the first compartment may be filled with gas; wherein the second compartment may be filled with fluid; wherein a movement of the piston within the closed space controls the buoyancy of the submersible pool cleaner.

The pool cleaning robot may include at least one sensor for sensing debris. The pool cleaning robot may include one or more sensors such as but not limited to a gyroscope, a geometrical sensor, an image sensor, an infrared sensor, a radar, a pressure sensor. The one or more sensors may positioned in any location of the pool cleaning robot. Sensors such as image sensors, geometrical sensors and infrared sensors may be at least partially positioned outside the housing of the pool cleaning robot or may have a field of view that extends through a window or aperture of the housing.

The underwater surface may be an upper surface of an underwater stair.

The propulsion module may include a jet generator that may be configured to generate one or more jets for propelling the submersible pool cleaner.

The propulsion module may include multiple impellers, wherein at least two impellers are oriented in relation to each other. These impellers may replace the fluid openings through which jets are ejected.

The pool cleaning robot may include a geometrical sensor that may be configured to detect various pool structural elements.

The propulsion module may include one or more jet generators that are configured to generate one or more fluid jets for maintaining the pool cleaning robot at a fixed position during at least a period during the hovering mode.

The one or more jet generators may be configured to (a) generate first fluid jets while the pool cleaning robot propagates towards the underwater surface, and (b) generate second fluid jets while the pool cleaning robot hovers over the underwater surface; wherein the first fluid jets are stronger than the second fluid jets.

The propulsion module may include a first jet generator and a second jet generator; wherein the first jet generator may be configured to generate first fluid jets while the pool cleaning robot propagates towards the underwater surface; wherein the second jet generator may be configured to generate second fluid jets while the pool cleaning robot hovers over the underwater surface; wherein the first fluid jets are stronger than the second fluid jets.

The pool cleaning robot may include an induction-based electrical charging module.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

Figure 1:
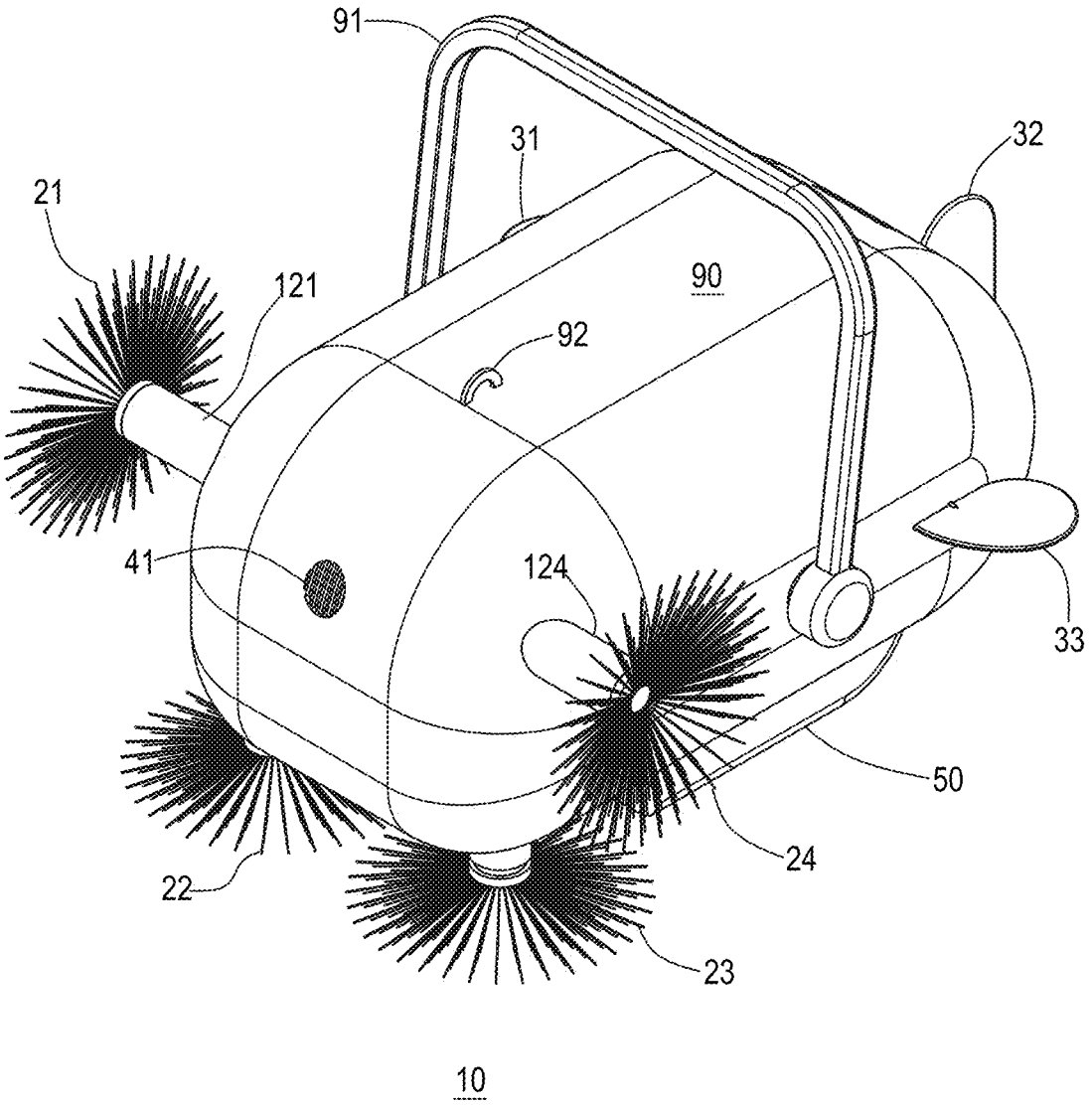
FIG. 1 illustrates a pool cleaning robot in which a door of a bottom skimmer is open according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

According to an embodiment of the invention there may be provided a pool cleaning robot that may include drive motor and/or pump motor, electrical power means, an optional power cable, an hydraulic path may include water suction intake and outlet, filtering element in the hydraulic path, an electronic control box, sensors, a carry handle and the like.

The pool cleaning robot is configured to hover over surfaces of the pool such as stairs, ledges without actually driving over said surfaces. During the hovering the pool cleaning robot may contact the surfaces by its cleaning elements and even only by its cleaning elements.

Overview

FIGS. 1-4 illustrate pool cleaning robot 10 according to various embodiments of the invention.

In FIGS. 1-4 the pool cleaning robot 10 is illustrates as having a skimmer 50 that is located at the bottom of the pool cleaning robot 10.

In FIG. 1 the pool cleaning robot 10 is illustrated as including right brush 21, a left brush 24, a right-bottom brush 22 and a left-bottom brush 23. Brushes 21, 22, 23 and 24 are positioned at the front part of pool cleaning robot 10. Brushes 21, 22, 23 and 24 are non-limiting examples of cleaning elements. The number, shape, size and position of the brushes may differ from those illustrated in any of the figures of this patent application.

The brushes (21, 22, 23 and 24) are connected to the housing 90 via arms—one arm per brush. For example, right arm 121 is connected between housing 90 and right brush 21. Left arm 124 is connected between the housing 90 and the left brush 24. Each of the arms may be hollow and defined a fluid path between the brush and the housing 90.

Pool cleaning robot 10 also includes a handle 91 for holding the pool cleaning robot 10 and a half-ring 92 that may be used to open a top cover to access and remove filtering mechanism 110 or apertured enclosure 112 for servicing.

Pool cleaning robot 10 is also illustrated as including rudder 32 and diving planes such as right diving plane 31 and left diving plane 33. Each one of the rudder 32 and diving planes 31 and 33 may be rotated about an axis in order to steer the pool cleaning robot 10. There may be more than a single rudder as well more than a single pair of diving planes.

Figure 2:
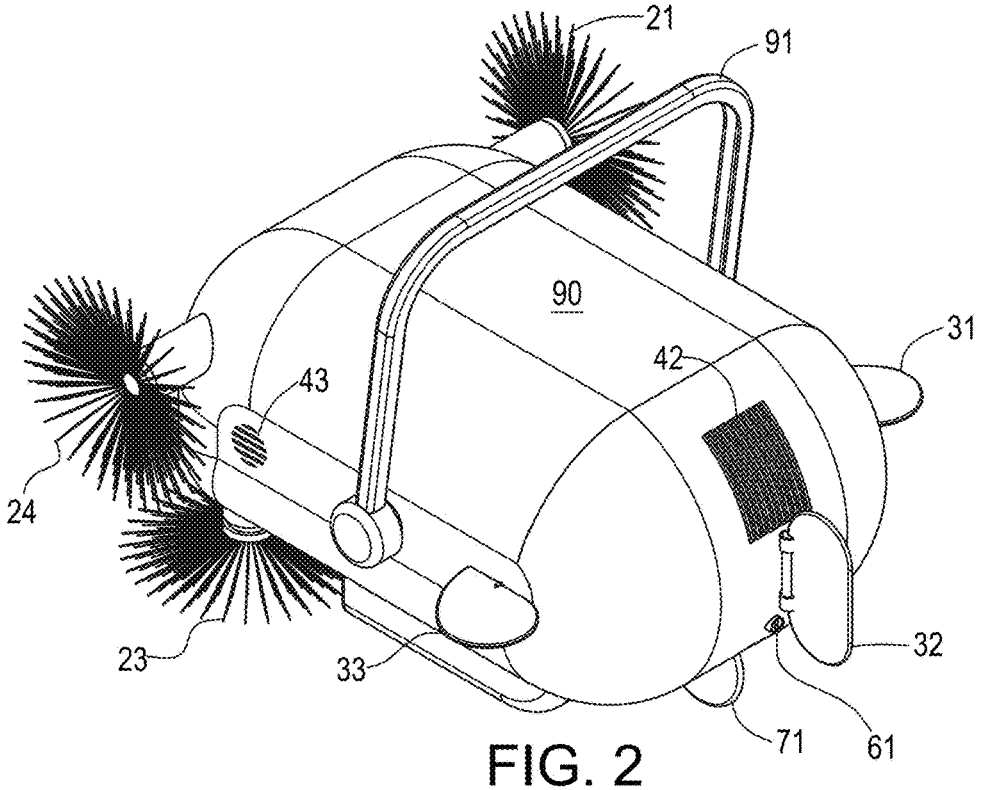
FIG. 2 is a left side view of a pool cleaning robot according to an embodiment of the invention.

FIG. 2 also illustrates front openings 41. A jet of fluid may be ejected through the front openings 41 during a steering of the pool cleaning robot 10.

FIG. 2 further illustrates the pool cleaning robot 10 as including (a) an electrical socket 61 for charging the pool cleaning robot 10 and (b) a wheel 71 that may balance the pool cleaning robot 10. The number of wheels may differ from one. If there are multiple wheels then one or two wheels may be parallel to each other, may be arranged in a sequence or may be arrange in any other manner. Multiple wheels may incorporate a tracking system. In FIG. 2 the wheel 71 and the right and left bottom brushes 22 and 23 form a triangle—and when brushes 22 and 23 and wheel 71 contacts a surface of the pool they provide a stable basis to the pool cleaning robot 10.

FIG. 2 further illustrates rear fluid opening 42 and left fluid opening 43. A jet of fluid may be ejected through each one of the rear fluid opening 42, left fluid opening 43, front fluid opening 41 (of FIG. 1) and right fluid opening (denoted 44 in FIG. 3).

Figure 3:
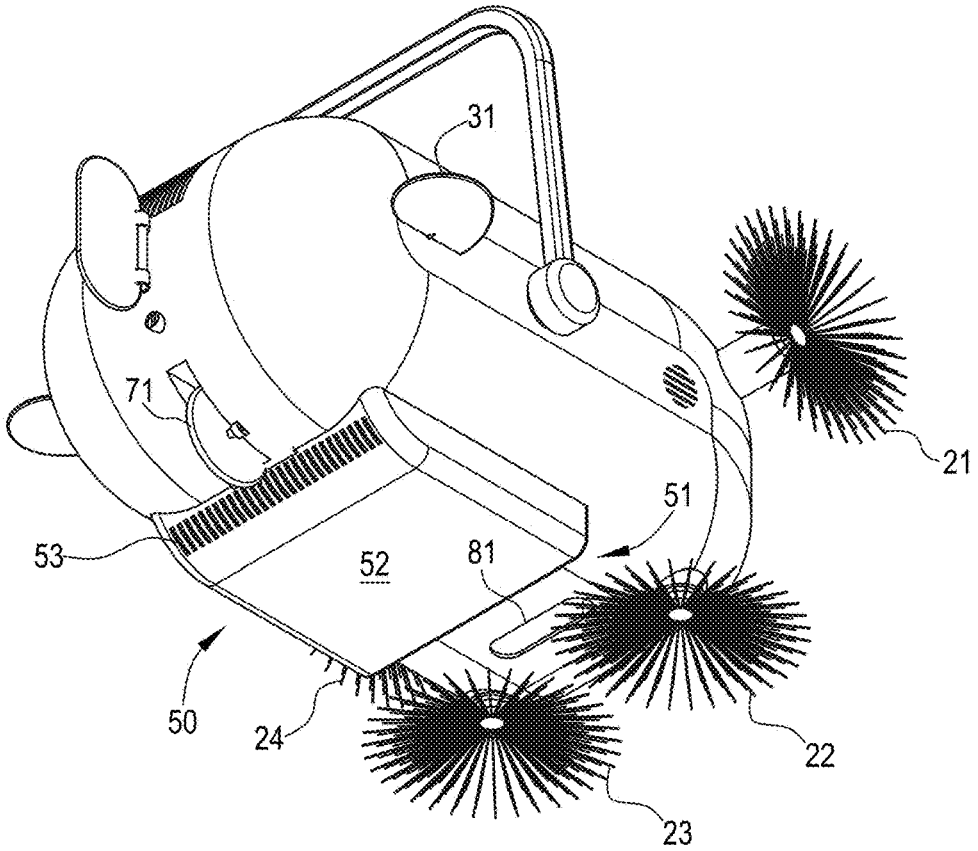
FIG. 3 is a bottom left side view of a pool cleaning robot according to an embodiment of the invention.
Figure 4:
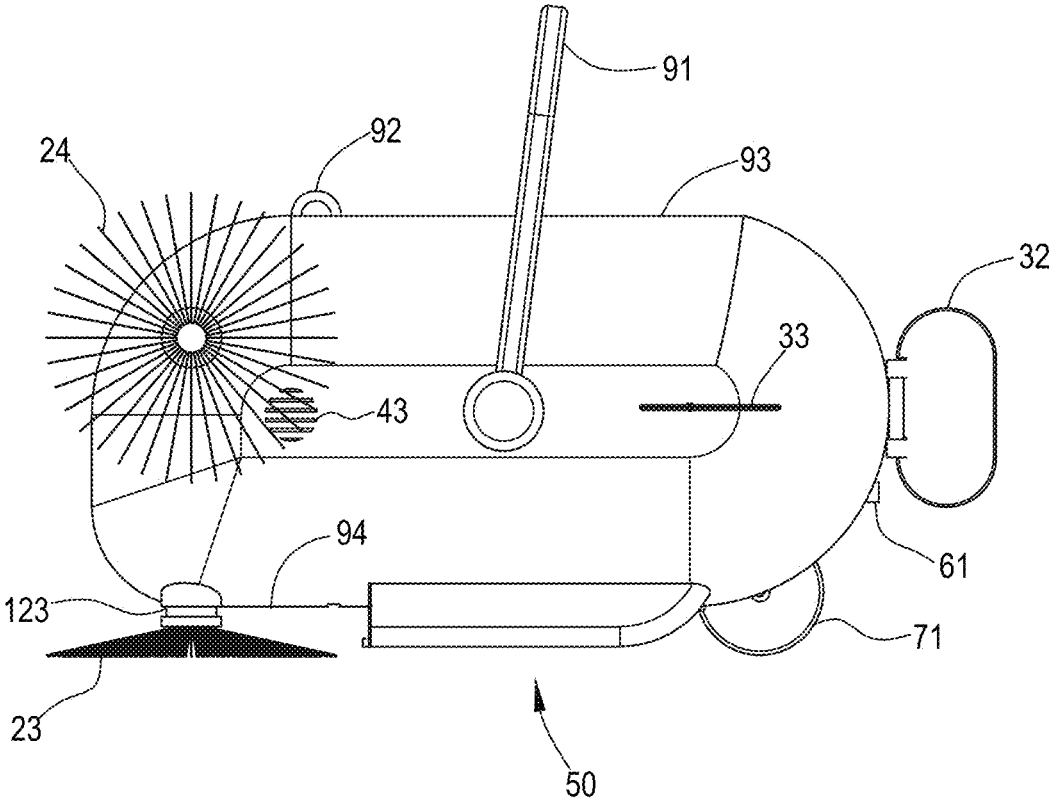
FIG. 4 is a left view of a pool cleaning robot according to an embodiment of the invention.

FIG. 3 also illustrates an inlet opening 81 positioned at the bottom of the housing—between the skimmer 50 and the arms that are connected to brushes 22 and 23.

Navigation and Steering

The maintaining of pool cleaning robot equilibrium may be achieved by incorporating at least one fin and/or a tail onto the external body contour that may serve as the steering system. In other words, the incorporation of a steering system such as a stern and/or sail planes near the stern, center or front of the pool cleaning robot. A rudder may be hinged vertically near the stern of the pool cleaning robot for steering. The steering system may be electronically controlled and activated by means of actuators or a servo motor in order to have full control over depth and/or bearing and to create non-horizontal angles.

Fins, rudder, stern and/or sail planes may be made of soft-flexible yet stiff polymeric material to reduce impact friction with pool surfaces.

The said non-horizontal angles may be initiated by means of the steering system and/or the ballast tanks.

In addition, a gyroscope or a gyrocompass may also be used to maintain balance, effective buoyancy and effective navigation.

Figure 7A:
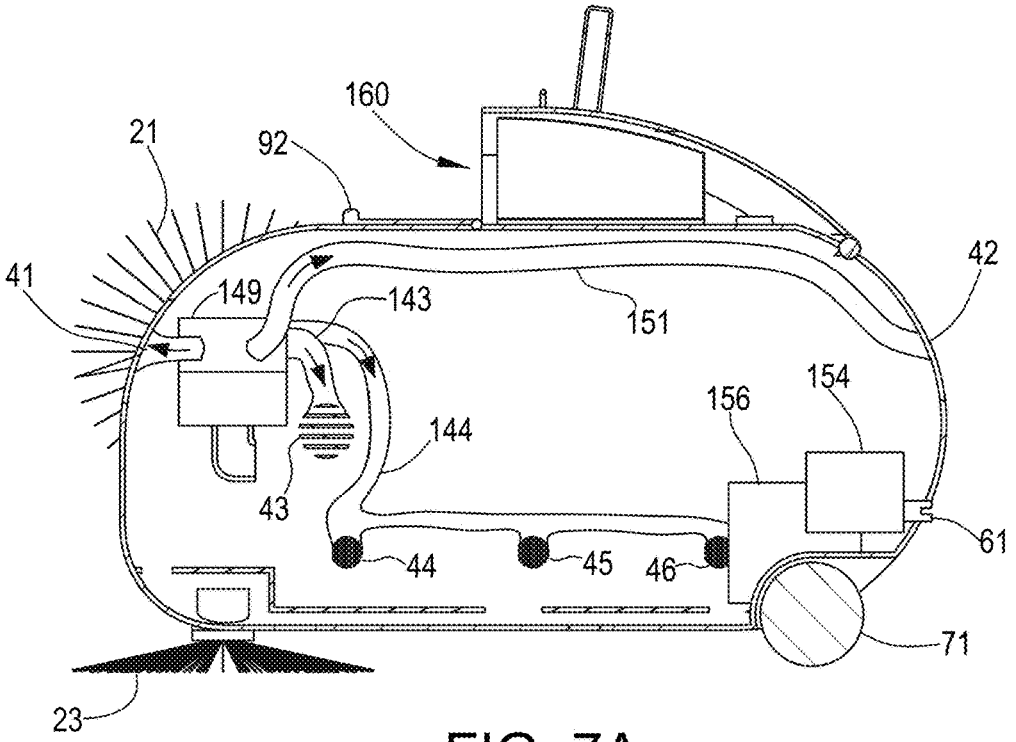
FIGS. 7A and 7B are side cross sectional view of pool cleaning robots according to various embodiments of the invention.
Figure 7B:
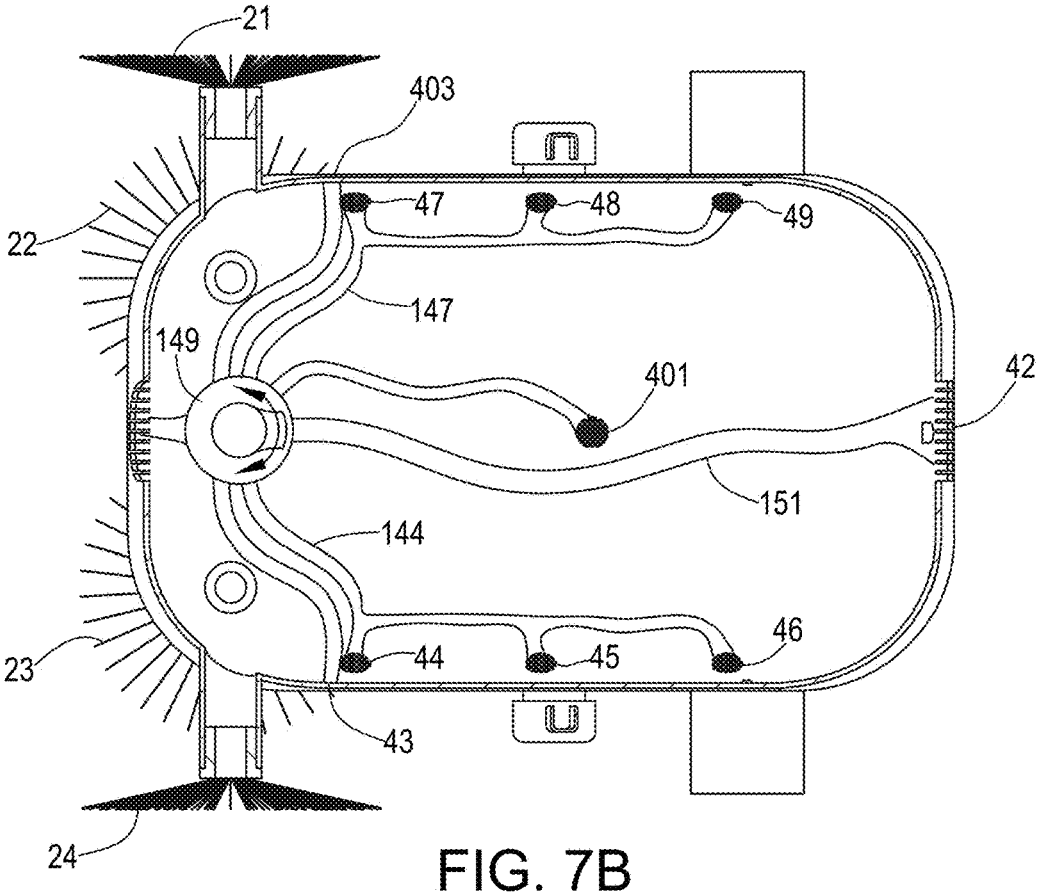
Figure 7C:
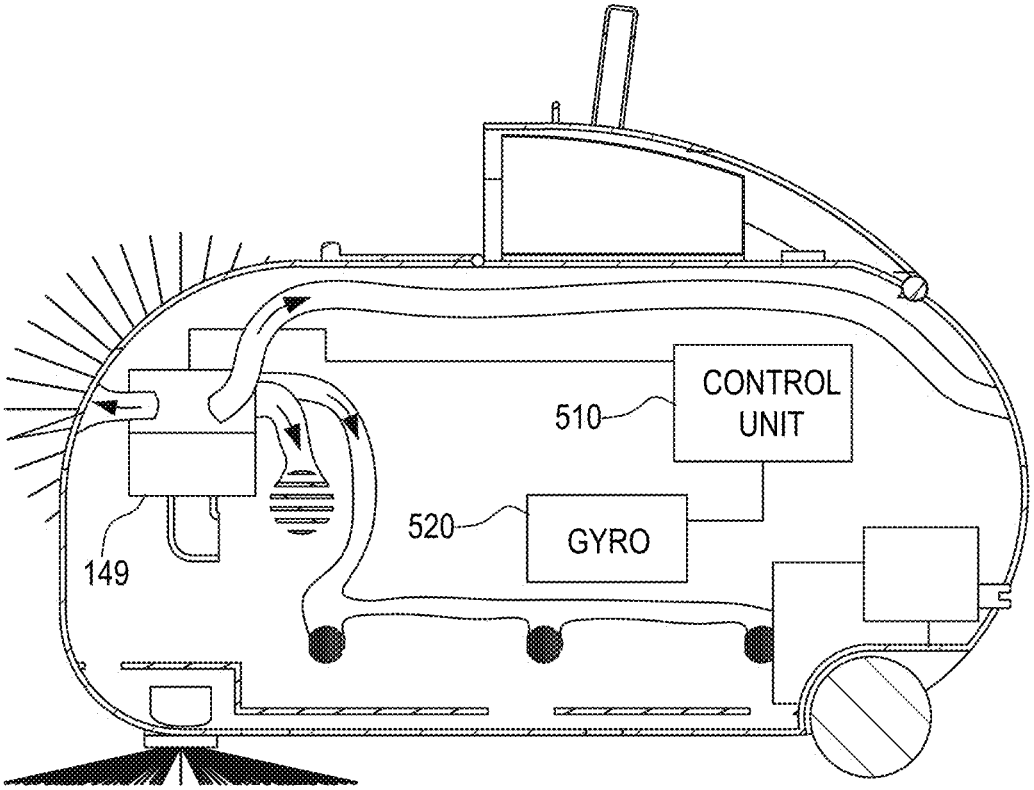
FIG. 7C illustrates a pool cleaning robot according to an embodiment of the invention.

In FIG. 7C the control unit 510 is illustrated as receiving motion and/or acceleration from gyroscope 520 and controlling the distribution of fluid to fluid openings in response to the gyroscope sensed information. For example, the control unit 510 may counter forces applied on the pool cleaning robot during the cleaning process and may counter these forces in order to maintain the pool cleaning robot at a fixed position or to move within a desired pattern (for example moving along a cleaned surface).

Figure 7D:
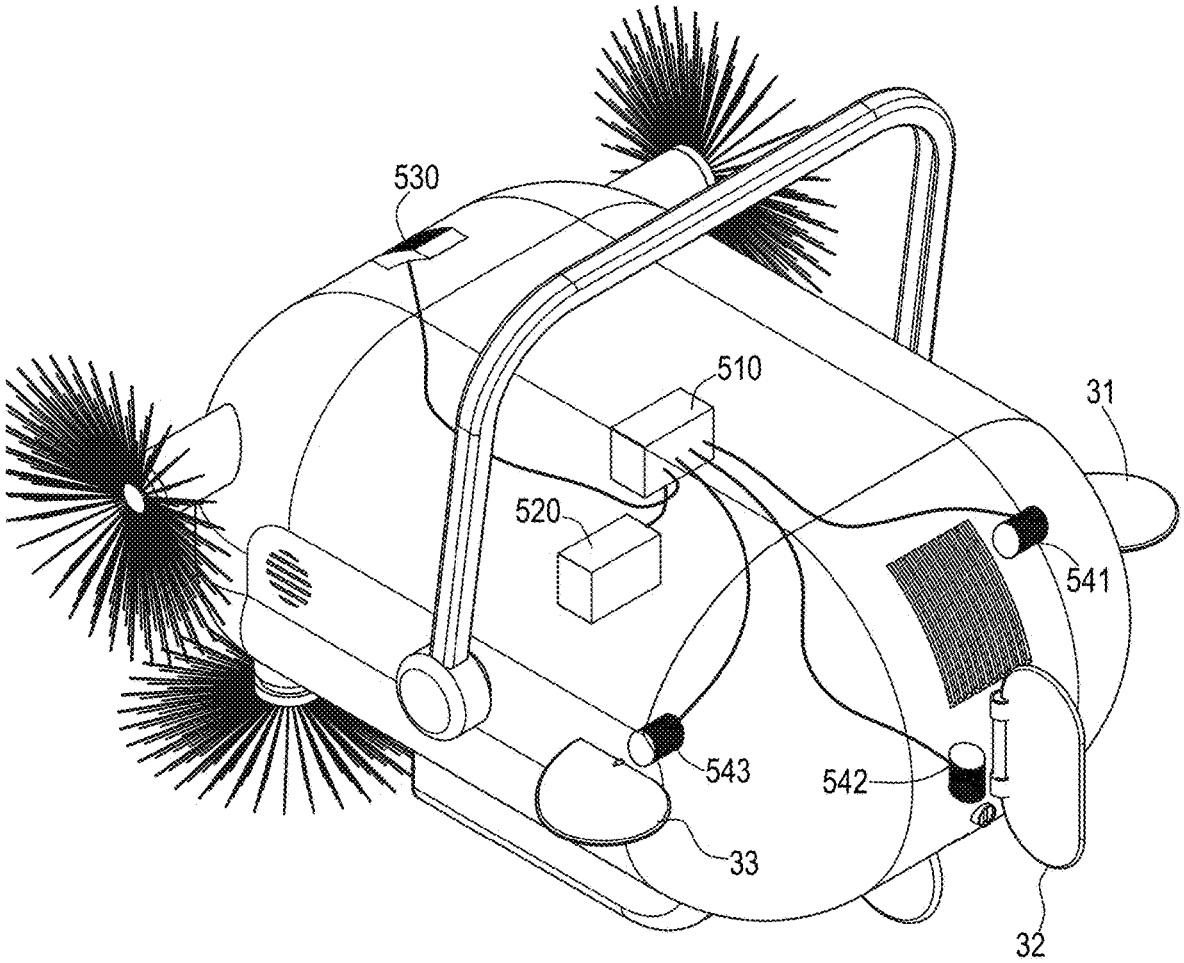
FIG. 7D illustrates a pool cleaning robot according to an embodiment of the invention.

In FIG. 7D the control unit 510 is illustrated as receiving motion and/or acceleration from gyroscope 520 and/or another sensor such as geometrical sensor 530 and controls the orientation of rudder 32 (via rudder motor or servo 542), right diving plane 31 (via right diving plane motor or servo 541) and/or left diving plane 33 (via left diving plane motor or servo 543). Motors and/or servos may be integrated into one motor unit in conjunction of liquid jet thrusts and/or said ballast tank system.

It is noted that electronic control unit 510 may control both the generation of fluid jets, ballast tank actuation and the members of the steering module.

In another embodiment, ballast tanks may be incorporated in the front and aft sections of the pool cleaning robot in order to shift water to areas in the pool cleaning robot. For example: if the pool cleaning robot wants to dive, water may be directed to a front section of the pool cleaning robot. This may be achieved, for example, by creating an initial non-horizontal angle of the pool cleaning robot in relation to the horizontal axis of the pool floor and/or water surface.

In a preferred embodiment, a ballast tank comprised of a compressed gas cylinder (172 of FIGS. 8A and 8B) may actuate a piston (171 in FIGS. 8A and 8B) to suck in water (into compartments 175) in order to make the pool cleaner heavy for descent from the waterline and vice versa. In other words, an active pumping and expelling of water in order to navigate but also to increase or decrease buoyancy for respectively surfacing or submerging.

Figure 8A:
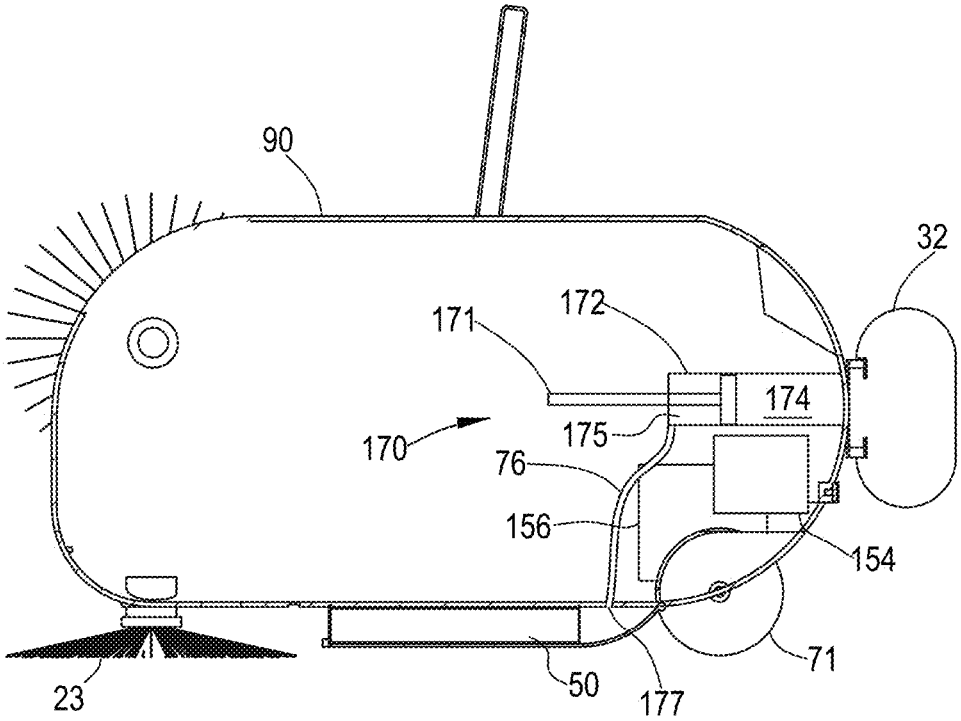
FIG. 8A illustrates a side cross sectional view of a pool cleaning robot according to an embodiment of the invention.

The piston 171 may compress or decompress gas within compartment 174 while sucking fluid provided via one or more fluid conduits—such as fluid conduit 176 of FIG. 8A that has an opening 177 at the bottom part of the pool cleaning robot 10—that fluidly couples the piston 171 and the skimmer 50.

Figure 8B:
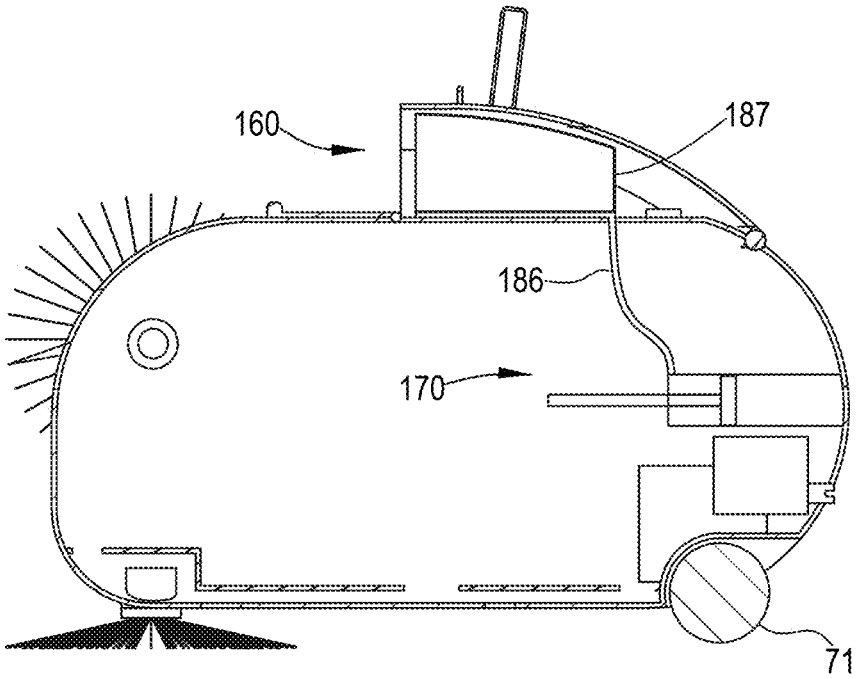
FIG. 8B illustrates a side cross sectional view of a pool cleaning robot according to another embodiment of the invention.

FIG. 8B illustrates the fluid conduit 186 as having an opening 187 at the upper part of the pool cleaning robot 10—that fluidly couples the piston 171 and skimmer 160 that is positioned at the top of pool cleaning robot 10.

Figure 10:
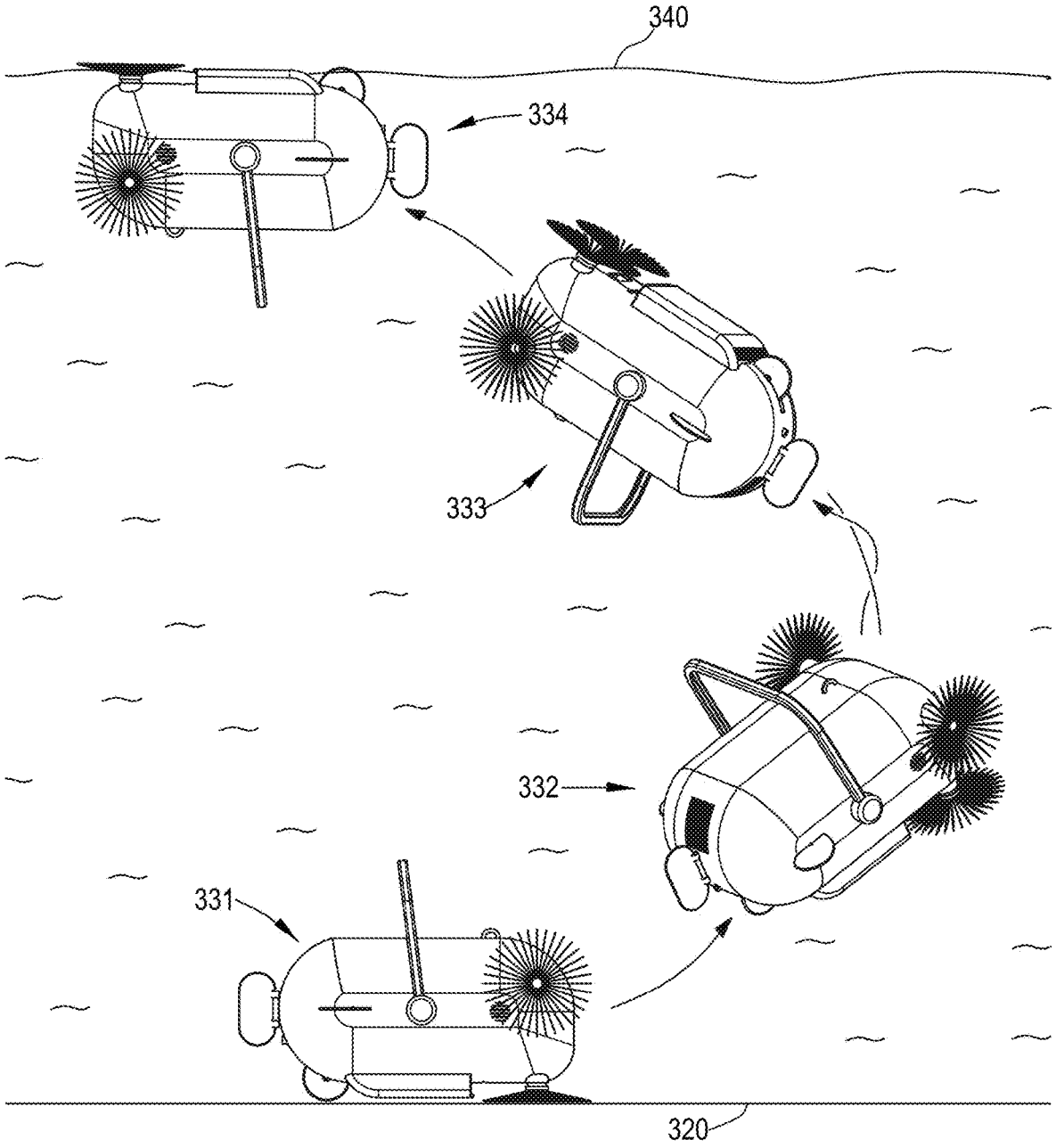
FIG. 10 illustrates a pool cleaning robot movement from pool bottom to pool surface whilst turning upside down performing loop to an inverted position at the waterline according to an embodiment of the invention.

FIG. 10 illustrates a process during which the pool cleaning robot 10 propagates from being at non-inverted position (331) at the bottom of the pool, until (after rotating by 180 degrees while floating towards the waterline 340) the pool cleaning robot 10 is positioned in proximity to the waterline 340 and is in an inverted position (position 334)—so that the skimmer 160 is positioned above housing 90. Positions 332 and 333 are intermediate positions of the pool cleaning robot 10 during the process.

When positioned in the inverted position (or during the process) fluid may be sucked by piston 171 through the skimmer and through the fluid conduit.

A single ballast tank or more may be used, but double hulls may also be used to shift water in pipes, tubes or ducts within the internal water flow management system.

The said an angle may be initiated by means of the said gyroscope in conjunction of the control unit.

Navigation, surfaces identification and distance measurements is performed by on-board sensors such as a transponder based tracking system to and from the charging station that may plot trajectory or depth, acoustic and ultrasonic navigation sensors, pressure sensors, optical sensors that may calculate velocities even during hover maneuvers and also identify patches of unclean surfaces etc. The charging station can be stationary or mobile. For example FIGS. 14-18 illustrate a mobile charging station.

Additional optical sensors and probes may be incorporated onto a pool cleaning robot module that may measure certain swimming pool water quality or chemistry parameters such as: temperature, chlorine level, PH level, salt level, turbidity, ORP and the like. This data may be wirelessly communicated directly or indirectly to a device held by an end user.

Jets and Fluid Based Propulsion

According to an embodiment of the invention there may be provided a pool cleaning robot that may travel in the volume of the pool water as a submarine vehicle without necessity to maneuver with wheels or tracks on pool surfaces but instead by using jets of ejected water and/or sucked fluid to create thrusts or use of Underwater Stream Jet Technology that may move the pool cleaning robot in forward, backwards, sideways and upward directions whilst suspended and moving in mid water.

According to an embodiment of the invention there may be provided a pool-cleaning robot that may include multiple fluid openings, with a fluid path between at least one water inlet opening and an array of fluid outlet openings that provide the water jet thrusts to drive the submarine pool cleaning robot. See, for example, FIGS. 7A and 7B. The fluid provided to each fluid opening can be controlled in response to or independently from the fluid provided to another fluid opening. The number of fluid openings and/or the locations of the fluid openings and/or the shape of the fluid openings may differ from those illustrated in the figures.

In FIG. 7A the pool cleaning robot 10 is illustrates as including rear fluid opening 42, front fluid opening 41 and multiple left fluid openings 43, 44, 45 and 46 that are positioned at different locations and at different distances from the front edge of housing 91. A carousel type nozzle 149 is fluidly coupled to the fluid openings 41, 42, 43, 44, 45 and 46 and may supply fluid in a controlled manner to facilitate the ejection of fluid jets through one or more of the fluid openings thereby controlling the steering of the pool cleaning robot 10 and/or maintaining the pool cleaning robot 10 at a same position—at least during a certain period that is a fraction of a duration of the hovering mode.

In FIG. 7A the same fluid conduit is used to supply fluid to left fluid openings 43, 44, 45 and 46. It is noted that different fluid paths may be provided to one or more of the left fluid openings 43, 44, 45 and 46. Any combination of fluid paths, valves, pressure controllers and the like may be provided between the fluid distributed and the fluid openings.

FIG. 7B further illustrates multiple right fluid openings 403, 47, 48 and 49 as well as fluid conduits 147 and 144.

The water thrust mechanism that is described in U.S. patent application Ser. No. 14/023,544, now U.S. Pat. No. 9,145,699, titled POOL CLEANING ROBOT which is incorporated herein in its entirety, may be used.

Alternatively, and is illustrated in FIG. 7 the pool cleaning robot 10 may include the carousel type nozzle that is being able to channel and divert water through multiple water conduits inside the pool cleaning robot may include jet outlets for fine tuning thrusts expelled from the external sides of the pool cleaning robot that are required to navigate the pool cleaning robot that floats between the pool surfaces.

The outward water thrust mechanism may be operated by electro-mechanical means that employ servo motors to operate a directional fluid distribution system.

The incoming drawn filtered water may be pushed towards a central water outlet nozzle mechanism that by means of a nozzle manipulator may be arranged to rotate the nozzle about a multitude of nozzle axis angles such as to alter an orientation of the rotational movement of the nozzle in relation to the longitudinal axis of the pool cleaning robot in order to change water flow orientation and to eject water through openings that are positioned in a symmetrical manner in relation to the longitudinal axis of the cleaning robot.

The water may be channeled through conduits or baffles that may be embedded in double walls in the body of the pool cleaning robot in order to direct the water to the various required outlets for navigation such as: the rear, the front, up, sides and fine tuning thrusts.

The robot may employ fine tuning low power thrusts of water jets to enable gentle thrusts to slowly navigate to and from approaches of areas in the pool by means of a diving, resurfacing and an all directions navigation mechanism whilst being suspended in mid water.

The robot may employ a propulsion module that comprises a first jet generator and a second jet generator. The first jet generator is configured to generate stronger, first fluid jets, in magnitude ranges of up to for example, 20 N force while the pool cleaning robot propagates towards the underwater surface. The second jet generator is configured to generate weaker, second fluid jets of fine tuning thrusts, in magnitude of for example, 0.05 N force while the pool cleaning robot hovers over the underwater surface. The first and second jet generators may share some components (such as a common fluid supply—see, for example, carousel type nozzle 149) of may include different components. The carousel type nozzle 149 is merely a non-limiting example of a jet distribution mechanism.

The carousel type nozzle 149 may include a servo motor actuated carousel comprising a rotary multi valve mechanism that controls and orientates the flow of fluid onto internal nozzles by means of a rotating spool. Smaller diameter nozzles may apply to fluid diversions into conduits to nozzles 44-46 or 47-49 that may be of smaller diameter for fine tuning pulses through outlet nozzles. Simultaneously, jets may be diverted to, for example, the main jet nozzle 42.

Filtering Mechanism

Figure 5:
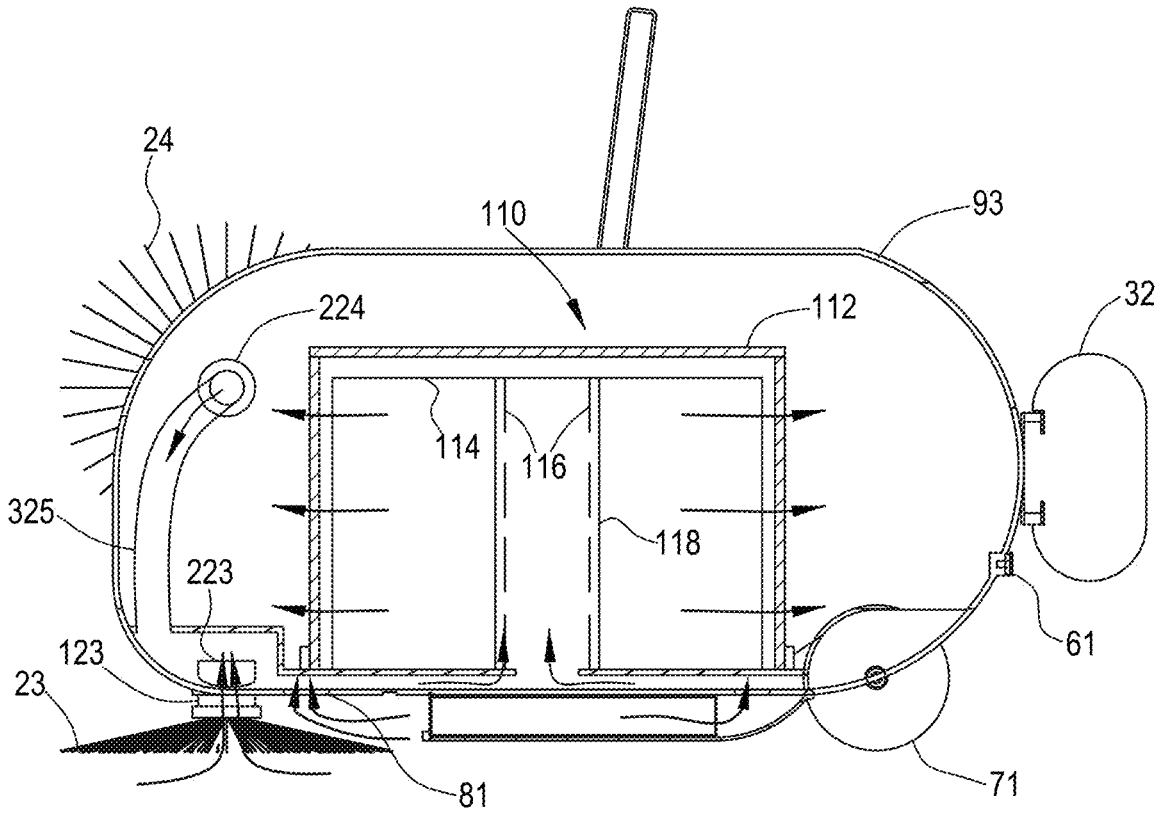
FIG. 5 is a side cross sectional view of a pool cleaning robot according to an embodiment of the invention.
Figure 6:
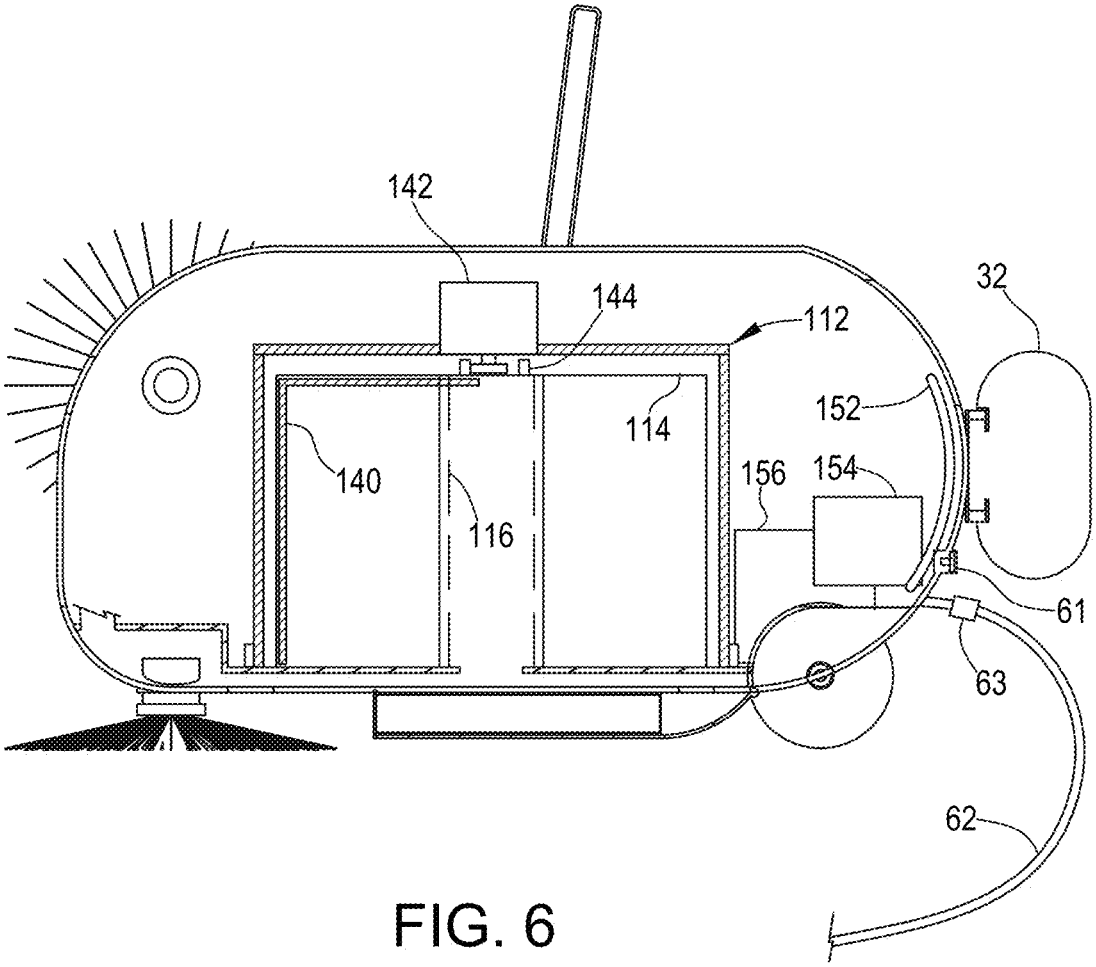
FIG. 6 is a side cross sectional view of a pool cleaning robot according to an embodiment of the invention.

The pool cleaning robot may include various filtering mechanism with a self-cleaning means. Non-limiting examples of such filtering mechanisms are depicted in FIGS. 5 and 6 and are also described in U.S. patent application Ser. No. 14/829,668, now U.S. Pat. No. 10,300,412, titled: POOL CLEANER WITH FILTER WITH SELF CLEANING MEANS AND HIGH INTERNAL PRESSURE which is incorporated herein in its entirety. Said filter embodiments provide extended and optimal filtering capacities. The filter may preferably be a revolving or moving type but may be a static nonmoving type that may include of internal integrated impeller blades (not shown) to create the required high internal pressure and subsequent water jet thrusts forces. A dedicated drive motor may be used to rotate the filtering unit and/or the self cleaning means. It is noted that any jet generator and/or the generation of a jet of fluid may be replaced by an impeller and a suction of repelling of fluid.

FIG. 5 illustrates the filtering mechanism 110 as including a filter core 118 that is located at the center of the filtering mechanism. The filter core 118 is surrounded by a coarse filter 116 of a cylindrical shape (or any other shape). The coarse filter is surrounded by a fine filter 114 where fluid filtered by the coarse filter 116 propagate through a space between the coarse and file filter to be filtered by the fine filter 114. The fine filter 114 is surrounded by an apertured enclosure 112. A self-cleaning process may include rotating the coarse and/or fine filters about their axes.

The arrows in FIG. 5 also illustrate that fluid is sucked towards the opening of filtering unit from skimmer, via opening 81, through an opening 223 within arm 123 and bottom left brush 23 and through an opening 224 within arm 124 and right brush 24.

FIG. 6 illustrates the filtering mechanism 110 that differs from the filtering mechanism of FIG. 5 by including an arm 140 that is in contact with the inner surface of the fine filter wherein a movement (for example rotation) of the arm 140 in relation to the fine filter 114 causes the fine filter 114 to be scrubbed by the arm. FIG. 6 also illustrates a motor 142 that is mechanically coupled via gear 144 for rotating the fine filter and an embodiment comprising of an electrical conduit cable 62 equipped by a cable swivelling mechanism 63.

One or more drive motors may be employed to provide the necessary force to rotate the filter, rotate the self cleaning filter means, the rotation of the suction brushes and the rotation of the balancing wheels.

Embodiments of the concept depicted in U.S. application Ser. No. 14/578,512, now U.S. Pat. No. 9,909,332, titled POOL CLEANER WITH A PROTRACTED FILTER may also be employed wholly or in part as a complimentary filtering system or pre-filtering system.

Balancing Wheel

The pool cleaning robot may also travel on pool surfaces by using at least one balancing wheel to offset the imbalance of protruding front rotating suction brushes in front. Floor movement may be achieved by means of the water jet thrusts but a drive motor or a gear connection may be used to actively rotate the wheel.

Additional sets of balancing wheels (not shown) may be placed in the front bottom section of the pool cleaning robot to further assist with a balanced surface/floor brushing movement.

Skimmer

There may be provided a pool cleaning robot that may include an integrated water skimmer at its upper region (or any other region) by which the pool cleaning robot may be programmed to travel to the water line level—in a water skimming mode—and thereby being partly-submerged whilst gliding across a surface of the swimming pool water. Water suction inlets may also be positioned in the submerged lower section of the skimmer create the suction power necessary to assist with the collection of floating dirt and debris that it may encounter whilst traveling in a forward movement direction. The skimmer is optional.

The skimmer may include a front baffle containing a float at its opening end so that when the pool cleaning robot sinks to the bottom, the baffle floats and shuts off the front skimmer opening to prevent the skimmed dirt from escaping.

The front baffle may be attached by means of a hinge so that when water is absent (for example, in a water skimming mode) the baffle will drop down horizontally to open the skimmer entrance to allow debris to enter the skimmer. When the pool cleaning robot sinks to the bottom, the baffle floats to a vertical position that shuts off the front skimmer opening to prevent the skimmed dirt from escaping.

The skimmer may be contained in a compartment that may include a removable mesh basket that may be made of plastic to collect all trapped debris. The compartment may be accessed from the top by the lifting of cover lid that is hinged to the main pool cleaning robot body thereby enabling removal or insertion of the skimmer basket.

FIG. 3 illustrates the skimmer 50 as including an enclosure 52 that has rear fluid opening 53 that is directed towards the rear end of the housing 90 and skimmer opening 51 that is directed towards the front end of housing 90.

The enclosure 52 is illustrated as having a substantially rectangular shape—but may have any other shape. The enclosure 52 has a width that well exceeds the height of the enclosure.

Figure 11A:
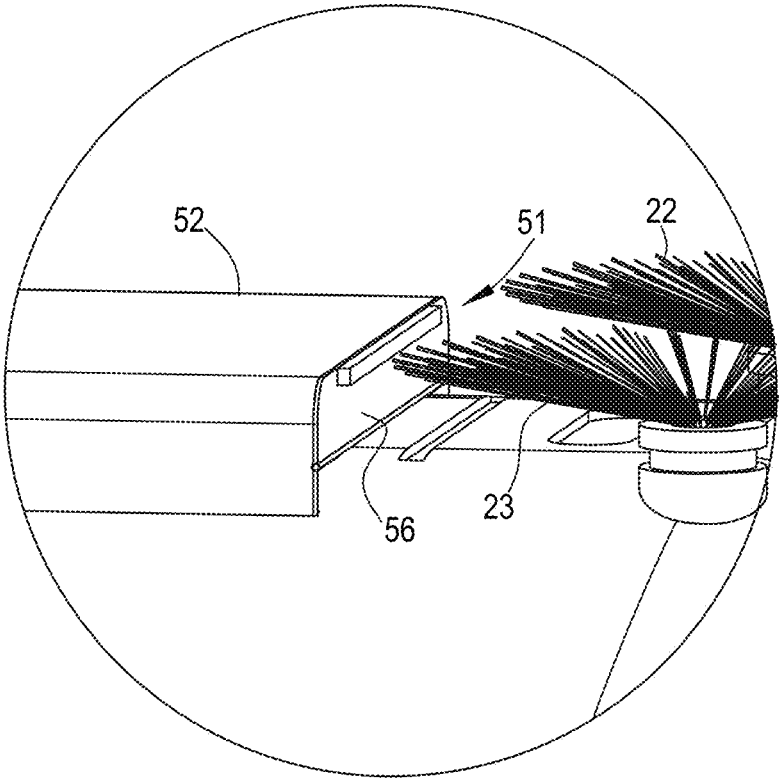
FIG. 11A illustrates a pool cleaning robot in which a door of a skimmer is closed according to an embodiment of the invention.
Figure 11B:
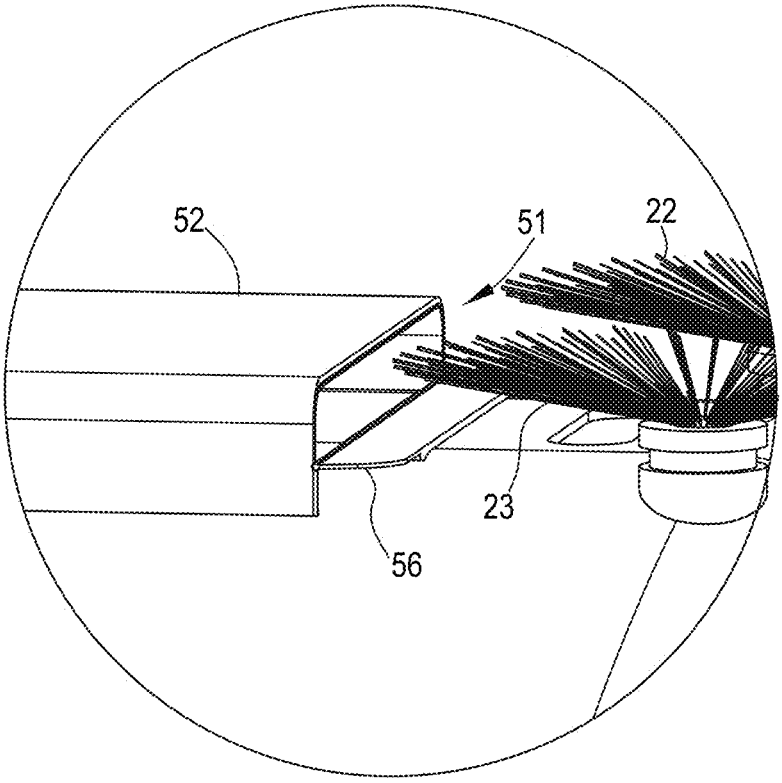
FIG. 11B illustrates a pool cleaning robot in which a door of a skimmer is open according to an embodiment of the invention.
Figure 12:
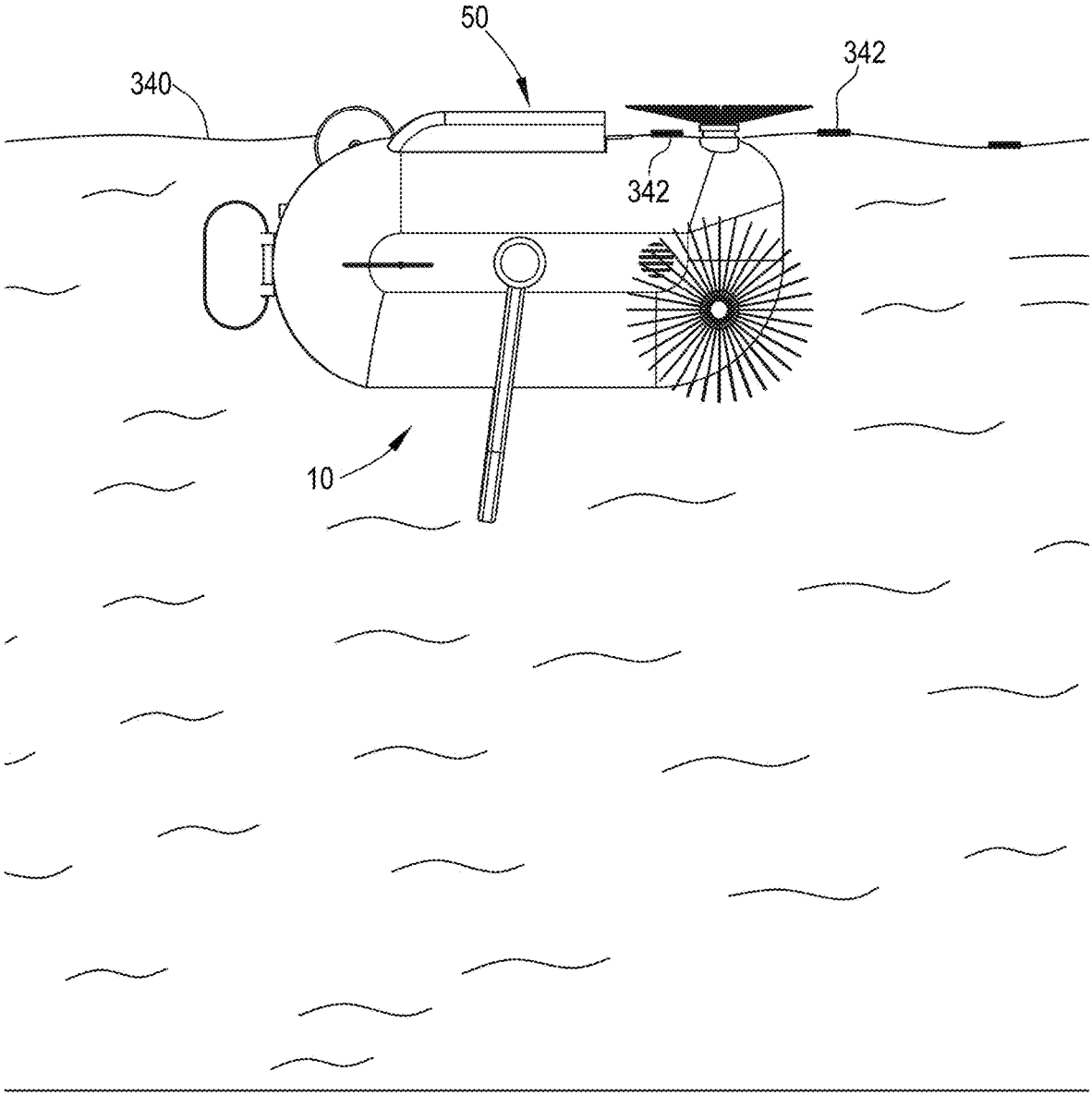
FIG. 12 illustrates a pool cleaning robot that performs skimming while positioned in an inverted position according to an embodiment of the invention.
Figure 13:
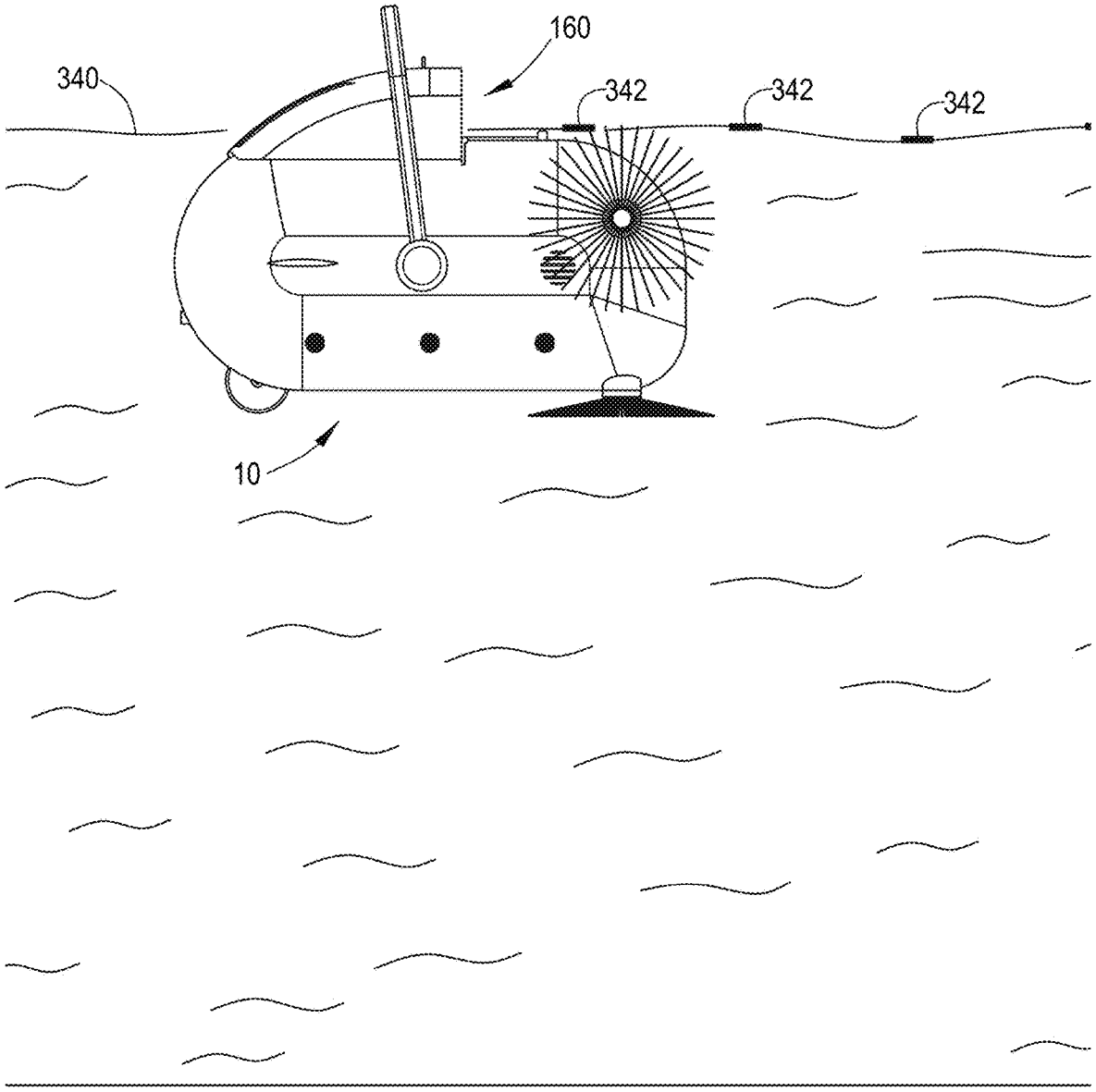
FIG. 13 illustrates a pool cleaning robot that performs skimming while positioned in a non-inverted position according to another embodiment of the invention.

In FIGS. 11A and 11B the skimmer 50 is illustrated as including a skimmer door 56 for selectively opening or closing the skimmer opening 51.

Figure 16:
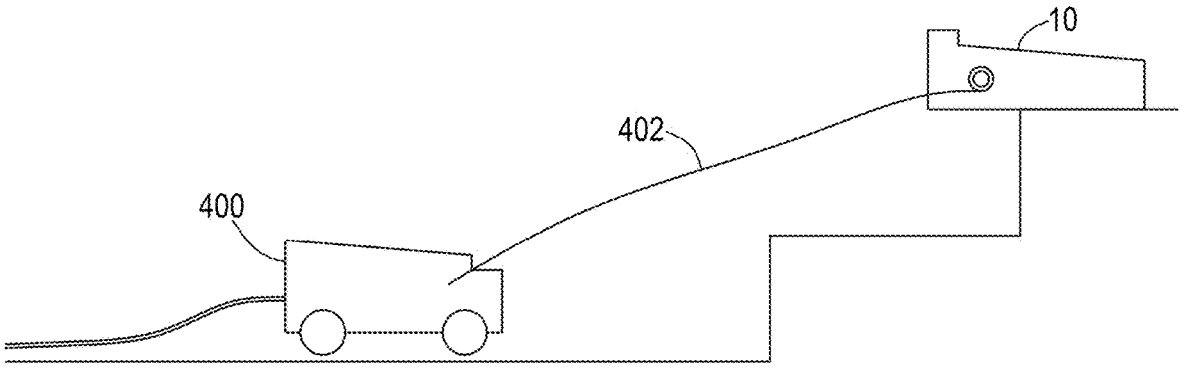
FIG. 16 illustrates a disconnected pool cleaning robot according to an embodiment of the invention.
Figure 17:
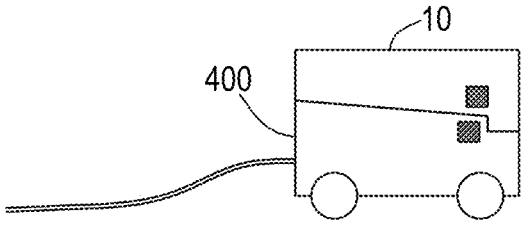
FIG. 17 illustrates another embodiment of a pool cleaning robot that is separated into two units according to an embodiment of the invention.
Figure 18:
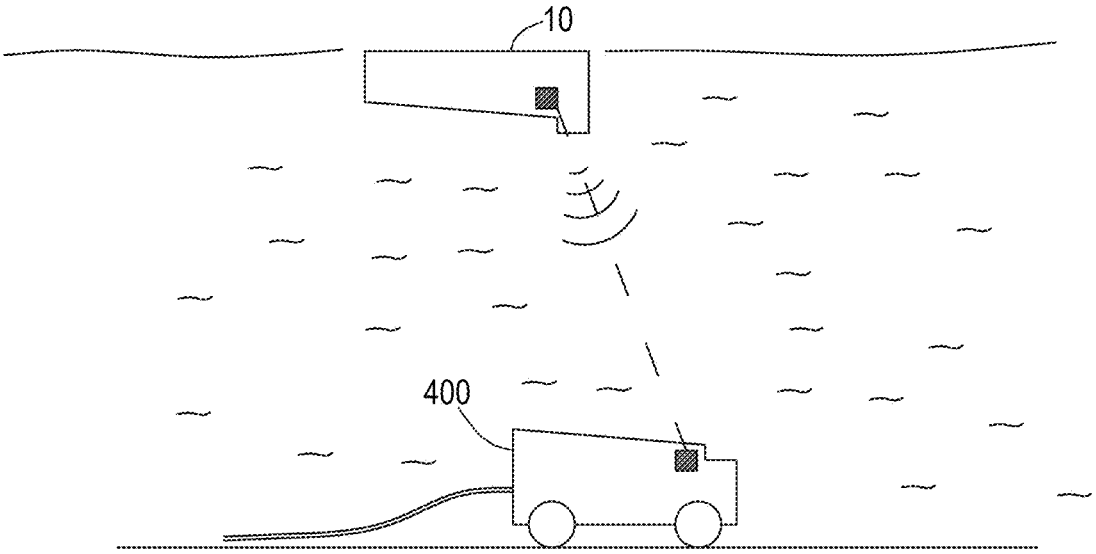
FIG. 18 illustrates a disconnected pool cleaning robot according to another embodiment of the invention.

FIGS. 7A, 8B and 16 illustrate a skimmer 160 that is positioned at the top of the housing 90.

Cleaning Brushes

FIGS. 1-4 illustrate non-limiting example of cleaning brushes. As indicated above the pool cleaning robot may include at least one set of rotating activated suction brush mechanism or suction brush tentacles in the front area, sides or back (see FIGS. 1-4) of the pool cleaning robot in order to brush, clean and vacuum dirt from the pool surfaces. The brush mechanism may also include of replaceable/removable bristles or sponges and may include of an integral suction mechanism able to draw in water from within the brush mechanism or brush tentacles towards the filtering mechanism.

The bottom brushes may be rotated in clock wise (CW) and/or counter clock wise (CCW) direction to enable directing of the dirt to a suction inlet placed between the two brushes.

The bottom brushes may perform surfaces navigation by means of CW and CCW rotating of the brushes. For example, stopping or stationing one brush whilst rotating the second brush may assist with the turning of the pool cleaner around the axis of the stationary brush. Turning both brushes in a CW or CCW sense may create a turning of the pool cleaner around the axis of the balancing wheel.

The brushes may include of flexible joints component that may bend and rotate in order to align the brushes bristles to the shape or angle of the surface that is being contacted for brushing and cleaning.

Each suction inlet may include choppers in the form of fast revolving blades to grind large incoming debris such as leaves to a more "digestible" form and size.

The rotating brush mechanism or brush tentacles may also be connected to the sides of the pool cleaning robot to connect with the sidewalls in order to brush and clean accumulated scum at water-line. This may also be performed whilst in a surface skimming mode.

The rotating brushes may include of suction inlets that are drawing in water from the suction force that is created in the filtering mechanism.

The drawn-in water may be channeled to the filter by travelling inside dedicated tubes that may also be embedded in double walls incorporated in the body of the pool cleaning robot.

Power Supply

The pool cleaning robot may include a rechargeable power source arranged to be charged by an on-board electrical generator and to supply electrical power during at least one period of time during which the generator does not extract energy.

The removable turbine means (may include a tube, gaskets, sealing mechanism) may be external to the pool-cleaning robot. The turbine may be at least partially disposed within the fluid path so as to extract energy from flow of fluid through the fluid path. The exact location of the turbine in the pool may be according to the end user choice and/or pool constraints (such as available fluid pressures). The turbine may therefore be powered by means of (a) a connection to a pool jet outlet that is part of the pool filtering system that circulates the pool water to and from its main filtering and pump system. A similar concept is described in PCT/IL2013/051055 titled AUTONOMOUS POOL CLEANING ROBOT which is incorporated herein in its entirety or (b) the turbine may be partially disposed and attached within to the fluid path in the skimmer outlet of the swimming pool. In both options, the jet flow of water may have a higher or stronger flow level of fluid within the flow at a majority of the pool. Such specific flow level creates both pressure and/or underwater acoustics that may be recognized by on-board navigational acoustic and/or pressure sensors.

The turbine and its dedicated hose may be submersibly connected by the end user by attaching the turbine and hose onto the fluid path that passes within the jet outlet or the skimmer inlet.

The turbine, when at least partially disposed within the fluid path in the jet or skimmer, may extract energy from flow and circulation of fluid through the fluid path.

The connected turbine may be removably attached to a pool side wall such as a pool water jet outlet or a skimmer inlet aperture and thereby form an underwater hydraulic charging station system.

The hydraulic charging station may include a sensor that may be arranged to sense a location of the pool-cleaning robot within the pool.

The pool cleaning robot may include a sensor that may emit a signal to a sensor in the charging station to facilitate underwater identification of a certain location that may be a charging station attached to a pool jet outlet or a skimmer inlet thus enabling navigation of the pool cleaning robot to the charging station.

The generator may be activated following a mechanical coupling of the turbine spindle or shaft of the charging station with the incoming pool cleaning robot's generator spindle/shaft.

Rotation of the turbine may activate rotation of the generator in order to charge on-board batteries that may be rechargeable lithium-ion type batteries.

Instead of a mechanical charging coupling, the generator and the charging may be activated by means of an inductive charging system. This will entail a first induction charging circuit contained within the external turbine/charging station and a second induction charging circuit contained within the pool cleaning robot in conjunction of the generator and rechargeable batteries.

In FIGS. 8A and 8B the charging coupling and/or second inductor circuit, generator 154 and battery 156 are depicted as being positioned in the aft of the pool cleaning robot. The entire system may well be positioned in the front of the pool cleaning robot.

The controller or control box of the pool cleaning robot may also be arranged to sense radiation emitted by the submersed charging station and thereby assist in directing the pool-cleaning robot towards a certain location or the charging station in order to connect the pool-cleaning robot and put it in contact with a charging station.

Charging Station

Another embodiment may include a charging station that may be an external docking station that may be placed outside of the pool water. The end user may lift and extract the pool cleaning robot from the swimming pool and place it onto said external docking station to perform charging. Charging may be mechanical by means of a drive motor powered by mains supply without necessity for additional and separate power supply pack. The charging may be achieved by employing a generator that may be located on the external docking station to contact pins that will charge on-board batteries. Generator may be located inside the pool cleaning robot.

The charging on the external docking station may also be achieved by induction.

Additional tasks, besides charging, may be performed on the docking station such as: manual filter replacements, automatic filter replacements, internal pool cleaning robot water jet cleaning.

The external docking station is described in U.S. patent application Ser. No. 14/710,615, now U.S. Pat. No. 9,903,130, titled AUTONOMOUS POOL CLEANING ROBOT WITH AN EXTERNAL DOCKING STATION that is incorporated herein in its entirety.

The pool cleaning robot may include two-way radio communication means between the memory chip or PCB in the control box to an external device that may be a handheld device such as a Smartphone that may also act a remote control. A Bluetooth® or other wireless mechanism may be used to connect to the internet. The two-way communication is a sender-receiver interface relationship by which data and commands are being exchanged between the user and the pool cleaning robot control system. The communication may be best achieved while the pool cleaning robot is semi-submersed, in a water skimming or sidewall brushing mode but other methods may be used such as an antenna or a float that are connected to the pool cleaning robot to enable communications while pool cleaning robot is fully submersed in water.

Figure 9:
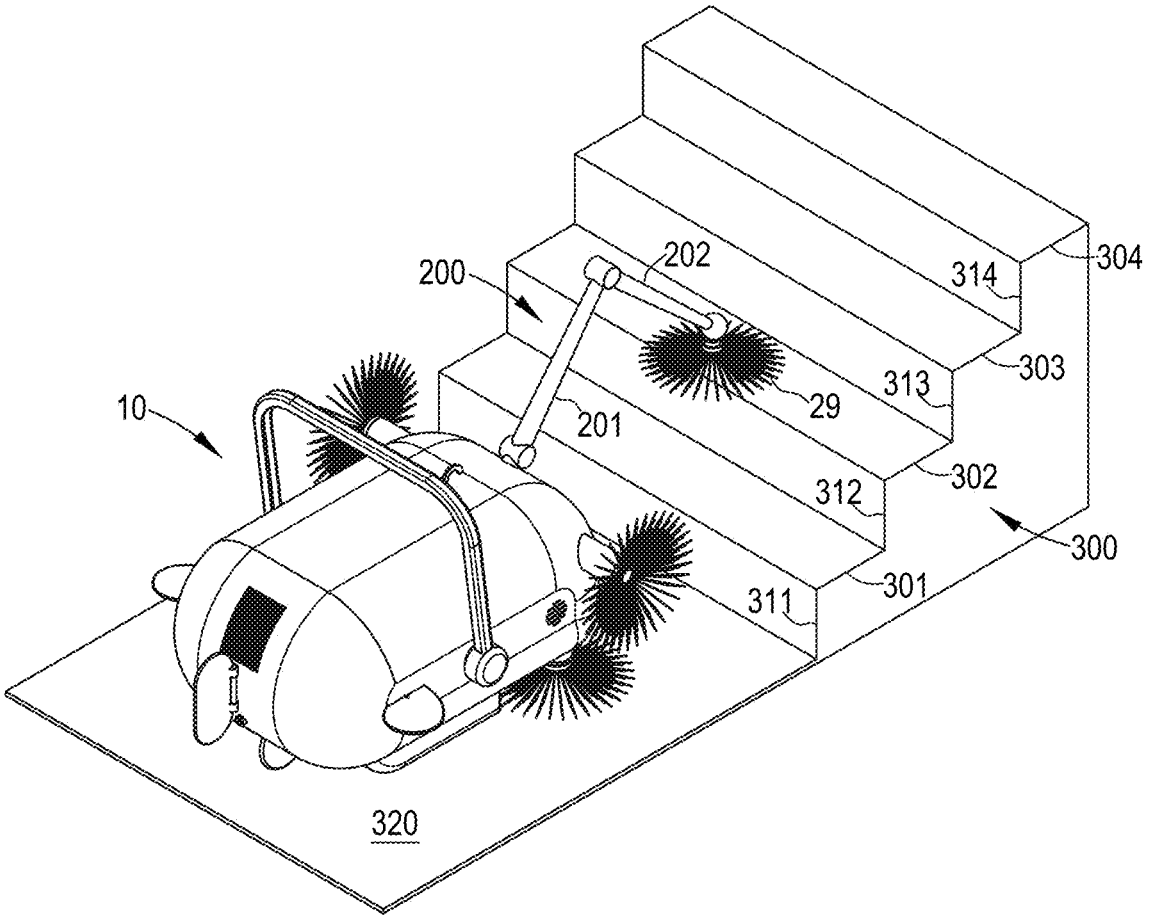
FIG. 9 illustrates a pool cleaning robot according to another embodiment of the invention.

FIG. 9 illustrates pool cleaning robot 10 according to an embodiment of the invention.

The pool cleaning robot 10 of FIG. 9 includes an arm 200 that extends from housing 90 and is connected to one or more brushing elements such as external brush 29.

Arm 200 may include one or multiple joints and one or more segments (such as segments 201 and 202) that are connected to the joints. Pool cleaning robot 200 may include one or more motors and/or control elements that control the position of arm 200 and the external brush 200.

Pool cleaning robot 200 may be configured to position the external brush 29 at a position that allows external brush 29 to clean surfaces that are above the housing 90.

FIG. 9 illustrates an underwater staircase 300 that includes four stairs that includes horizontal surfaces 301, 302, 303 and 304 and vertical surfaces 311, 312, 313 and 314. FIG. 9 also illustrates a bottom of the pool 302 on which pool cleaning robot 10 is positioned (hovers above) while arm 200 cleans one or more surfaces out of horizontal surfaces 301, 302, 303 and 304 and vertical surfaces 311, 312, 313 and 314. Arm 200 may include telescopic bars, extendable or retractable bars, elastic and/or non-elastic segments.

In FIG. 9 external brush 29 faces horizontal surface 302. The external brush 29 may be oriented at any angle in relation to the horizon. For example—when cleaning any one of vertical surfaces 311, 312, 313 and 314 the external brush 29 may be vertically oriented.

It is noted that during the cleaning of any of said surfaces the pool cleaning robot 10 may maintain static by countering any force applied on the external brush 29 by any cleaned surface using fine tunes fluid jets.

Pool cleaning robot 100 may also hover above surface 320 or any other surface illustrated in FIG. 9 while cleaning one or more stairs. It is noted that while bottom left and/or bottom right brushes clean one stair the arm 200 can be used to clean another stair.

Split Configuration

FIGS. 14-18 illustrate pool cleaning robot 10 and a base 400 according to an embodiment of the invention.

Base 400 and the pool cleaning robot 10 may be coupled to each other by cable 402 or may be wirelessly coupled to each other.

The pool cleaning robot 10 may detach from base 400 and propagate through the fluid of the pool- and reach any underwater or fluid surface location.

Figure 14:
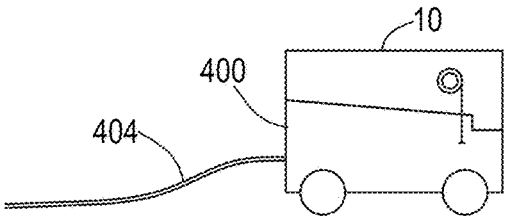
FIG. 14 illustrates a pool cleaning robot that is disconnectable into two units according to an embodiment of the invention.
Figure 15:
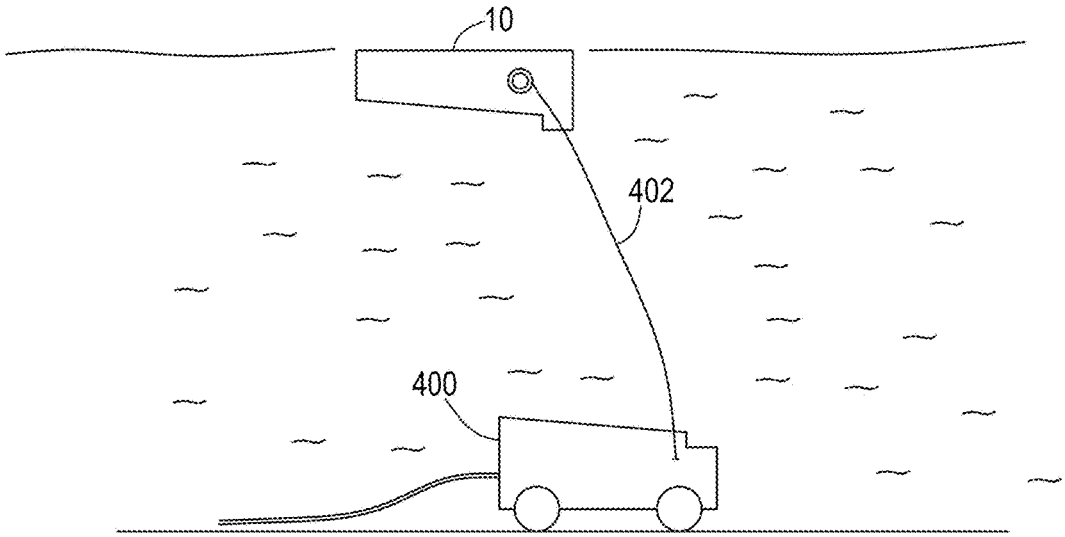
FIG. 15 illustrates a disconnected pool cleaning robot according to an embodiment of the invention.

Pool cleaning robot 10 may be any of the pool cleaning robots illustrated in any of the figures that precede FIG. 14. Alternatively—the pool cleaning robot may be modified in other to enable an easy attachment to the base 400. For example—the pool cleaning robot may include an upper skimmer. Alternatively—the pool cleaning robot may include a lower skimmer and the lower skimmer and the base upper surface may match each other.

Base 400 may supply electrical power to the pool cleaning robot via cable 402 or in a contactless manner (for example via induction). Base 400 may be charging station.

Base 400 may move along the bottom of the pool while pool cleaning robot is supported by base 400—which may be highly effective from an energy consumption point of view as the base 400 may move by contacting the bottom of the pool—which is more cost effective than fluid jet propulsion based movement.

Base 400 may include sensor for detecting debris and/or may include navigation sensor for sending the location of the base and may direct the base 400 to the proximity of debris to be cleaned or to desired locations such as an underwater staircase.

Any combination of any components illustrated in any of the figures is provided. A pool cleaning robot may include, for example, one or more arms 200 as well as filtering unit 110.

Any reference to the term "comprising" or "having" should be interpreted also as referring to "consisting" of "essentially consisting of". For example—a pool cleaning robot that comprises certain components can include additional components, can be limited to the certain components or may include additional components that do not materially affect the basic and novel characteristics of the pool cleaning robot—respectively.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A pool cleaning robot, comprising:

a housing;

a filtering mechanism configured to filter fluid;

at least one cleaning element;

a propulsion module that is configured to propel the pool cleaning robot; and an inverter that is configured to invert the housing during a part of a diving process of the pool cleaning robot.

2. The pool cleaning robot according to claim 1 wherein the inverter comprises a piston.

3. The pool cleaning robot according to claim 1 wherein the inverter is at least one ballast tank.

4. The pool cleaning robot according to claim 3 wherein the at least one ballast tank is configured to determine a tilt angle of the pool cleaning robot during the part of the diving process of the pool cleaning robot.

5. The pool cleaning robot according to claim 4 wherein the ballast tanks are incorporated in a front section and an aft section of the pool cleaning robot.

6. The pool cleaning robot according to claim 3 wherein the at least one ballast tank comprises ballast tanks.

7. The pool cleaning robot according to claim 6 wherein the ballast tanks are configured to tilt the pool cleaning robot by directing water between the ballast tanks.

8. The pool cleaning robot according to claim 3 wherein the at least one ballast tank is a single ballast tank.

9. The pool cleaning robot according to claim 3 comprising at least one fluid conduit for selectively filling the at least one ballast tank with fluid; wherein the at least one fluid conduit has an opening that is positioned at a lower part of the pool cleaning robot.

10. The pool cleaning robot according to claim 3 comprising at least one fluid conduit for selectively filling the at least one ballast tank with fluid; wherein the at least one fluid conduit has an opening that is positioned at an upper part of the pool cleaning robot.

11. The pool cleaning robot according to claim 3 comprising:

a skimmer that is positioned at a lower part of the pool cleaning robot; and at least one fluid conduit for selectively filling the at least one ballast tank with fluid; wherein the at least one fluid conduit fluidly couples the skimmer to the at least one ballast tank.

12. The pool cleaning robot according to claim 11 wherein the at least one ballast tank is configured to suck fluid through the at least one fluid conduit when the pool cleaning robot is in an inverted position.

13. The pool cleaning robot according to claim 12 when the pool cleaning robot is configured to be in the inverted position when collecting floating dirt that floats on a fluid of the pool.

14. The pool cleaning robot according to claim 3 comprising:

a skimmer that is positioned at an upper part of the submersible pool cleaner; and at least one fluid conduit for selectively filling the at least one ballast tank with fluid; wherein the fluid conduit fluidly couples the skimmer to the at least one ballast tank.

15. The pool cleaning robot according to claim 14 wherein the ballast tank is configured to suck fluid through the fluid conduit when the pool cleaning robot is in a non-inverted position.

16. The pool cleaning robot according to claim 15 when the pool cleaning robot is configured to be in the non-inverted position when collecting floating dirt that floats on a fluid of the pool.

17. The pool cleaning robot according to claim 3 wherein the at least one cleaning element comprises one or more bottom brushes that are coupled to a bottom of a housing of the cleaning robot and one or mode side suction brushes that are coupled to sides of the housing.

18. The pool cleaning robot according to claim 3 wherein the at least one cleaning element comprises one or more bottom brushes that are coupled to a bottom of a housing and one or more balancing wheels that are spaced apart from the one or more bottom suction brushes.

19. The pool cleaning robot according to claim 3 wherein each of the at least one ballast tank comprises a piston that is contained in a closed space; wherein the piston partitions the closed space to a first and second compartment; wherein the first compartment is filled with gas; wherein the second compartment is filled with fluid; wherein a movement of the piston within the closed space controls the buoyancy of the pool clean robot.

20. The pool cleaning robot according to claim 3 comprising at least one sensor for sensing debris.

21. A method for operating a pool cleaning robot, the method comprises: executing a diving process of the pool cleaning robot, wherein the executing comprises inverting a housing of the pool cleaning robot, by an inverter, during a part of the diving process of the pool cleaning robot; wherein the method further comprises filtering fluid by a filtering mechanism of the pool cleaning robot; and propelling, by a propulsion module of the pool cleaning robot.

* * * * *